US005505137A

United States Patent [19]

Godefroy et al.

[11] Patent Number: 5,505,137

[45] Date of Patent: Apr. 9, 1996

[54] PRACTICE PROJECTILE

[75] Inventors: Jean-Marie Godefroy, Creuzier-le-Vieux; Philippe Maillard, Bellerive-sur-Allier, both of France

[73] Assignee: Manurhin Defense, Versailles, France

[21] Appl. No.: 249,273

[22] Filed: May 25, 1994

[30] Foreign Application Priority Data

May 25, 1993 [FR] France ..... 93 06183

[51] Int. Cl.[6] ..... F42B 8/14

[52] U.S. Cl. ..... 102/529; 102/506; 102/517

[58] Field of Search ..... 102/395, 498, 102/502, 506, 517, 529

[56] References Cited

U.S. PATENT DOCUMENTS

| | | | |
|---|---|---|---|
| H770 | 3/1990 | Kline et al. | 102/529 |
| 221,249 | 11/1879 | Nowlan | 102/506 |
| 3,170,405 | 2/1965 | Jungermann et al. | 102/529 |
| 3,338,167 | 10/1965 | Jungermann et al. . | |
| 3,785,293 | 1/1974 | Barr et al. | 102/529 |
| 4,140,061 | 2/1979 | Campoli | 102/529 |
| 4,242,960 | 1/1981 | Boeder et al. | 102/529 |
| 4,411,200 | 10/1983 | Brede et al. | 102/529 |
| 4,535,698 | 8/1985 | Yuen | 102/529 |
| 5,097,767 | 3/1992 | Cirillo | 102/506 |

FOREIGN PATENT DOCUMENTS

| | | | |
|---|---|---|---|
| 799185 | 11/1968 | Canada | 102/529 |
| 2509457 | 1/1983 | France . | |
| 734429 | 3/1943 | Germany . | |
| 2639884 | 3/1978 | Germany . | |
| 3116175 | 11/1982 | Germany | 102/502 |
| 3803369 | 8/1989 | Germany | 102/529 |
| 3819251 | 12/1989 | Germany . | |
| 445341 | 10/1967 | Switzerland . | |
| 1157555 | 7/1969 | United Kingdom . | |

*Primary Examiner*—Harold J. Tudor
*Attorney, Agent, or Firm*—Oliff & Berridge

[57] ABSTRACT

A practice projectile includes a body formed from assembling a number of sectors. The sectors are made of plastic and designed to be received in a receptacle of a base. The body is held together during handling by a holder. The holder is designed to release the sectors once they exit the barrel of a weapon when the projectile is fired.

14 Claims, 8 Drawing Sheets

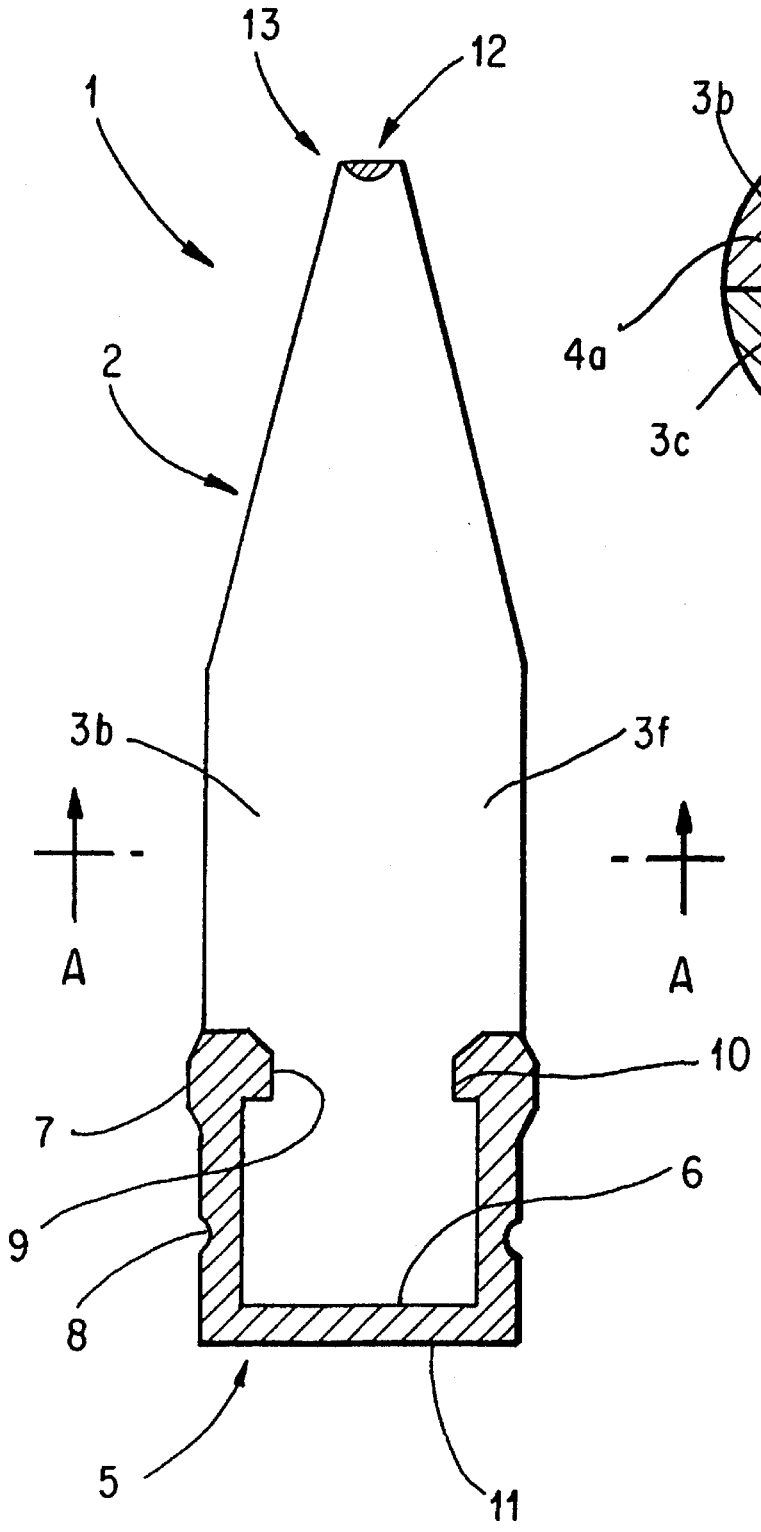
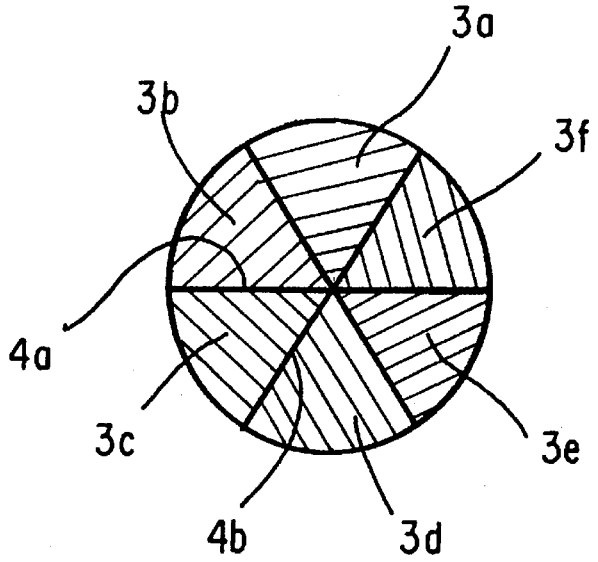
FIG.1B
FIG.1A

PRACTICE PROJECTILE

BACKGROUND OF THE INVENTION

The technical field of the present invention relates to practice munitions and projectiles, and in particular, to projectiles that disintegrate as they leave the barrel of a weapon.

In the field of practice munitions, a distinction is generally drawn between those designed to reproduce the actual ballistics of a live projectile, but over a short distance, (i.e., practice projectiles that follow at least a partial ballistic trajectory) and those designed only to reproduce the environment specific to firing (noise, recoil, smoke, etc.).

The first type of practice munitions is illustrated by patents FR 2509457 and DE 734429, both of which describe a projectile having a body formed by assembling several segments. This type of practice projectile is designed to reproduce the actual ballistics of a live projectile over a predetermined distance. Therefore, this projectile includes structure to ensure that the various segments are held together over a portion of the trajectory. Use of this type of practice projectile requires installing a firing safety fixture. In addition, this type of practice projectile can be used only to reproduce the firing environment.

For munitions that are designed to reproduce a firing environment, so-called blank munitions having no projectile are known. In other words, the portions of these munitions that are fired fall to the ground at a short distance from the weapon and thus do not follow a ballistic trajectory. These munitions have the disadvantage of requiring the addition of auxiliary devices to allow rearming of the weapon.

Breakup munitions, which fire a projectile comprising a steel- or tungsten-powder charge disposed in a brittle envelope, are also known. This type of projectile explodes under the influence of centrifugal inertia forces as it leaves the barrel. U.S. Pat. No. 3,338,167 and CH 445341 describe such munitions, which have the advantage of being firable without modifying the weapon.

A breakup projectile, however, has several disadvantages. First, such a projectile is costly, because it requires the production of a metal-powder charge with specific mechanical characteristics. Second, this charge must be sufficiently dense and compact to ensure the mechanical integrity of the projectile, but it must nonetheless disperse easily upon exiting the weapon barrel. Third, the integrity of such a charge during storage is uncertain because the metal powders oxidize, resulting in detrimental changes in the behavior of the projectile both while it is in the barrel and upon its exit. Moreover, these projectiles frequently explode inside the barrel of the weapon, and thus cause it to deteriorate. Furthermore, the dense powder dispersed in the vicinity of the mouth of the weapon may damage the weapon optics system and even injure personnel.

SUMMARY OF THE INVENTION

A goal of the invention is to provide a practice projectile that disintegrates as it exits the weapon barrel (i.e., the projectile follows a non-ballistic trajectory) but does not have the drawbacks of the breakup projectiles according to the prior art.

Thus, the projectile according to the invention is inexpensive and does not adversely affect the barrel of the weapon. It also has excellent storage life even under the harshest weather conditions.

Another object of the invention is to provide a process that is particularly advantageous for manufacturing such a practice projectile.

These and other objects are achieved by providing a practice projectile comprising a body formed by assembly of several sectors and a base having a recess designed to receive the various sectors, the sectors being made of plastic. The projectile includes a holder that holds together the assembly of sectors during the handling phases and is designed to release the sectors as they exit the barrel of a weapon when the projectile is fired. The sectors are preferably made of a thermoplastic material.

According to one of the various embodiments, the holder may comprise a fairing surrounding a forward part of the projectile. The fairing may have a strip that penetrates an annular recess provided on the sectors and ensures that the fairing is attached to them.

According to another embodiment, the holder may be comprised of one or more of the following: a sleeve surrounding a forward part of the projectile, the sleeve being made of a heat-shrink material; at least one spot weld between any two contiguous sectors; at least one extension integral with one sector and cooperating with a groove provided on a sector contiguous with the preceding sector, which groove has a shape matching that of the extension; and a central zone formed in a single piece with at least two sectors regularly spaced angularly and forming a first group of sectors.

In the latter case, the first group of sectors delimits receptacles in which the other sectors are disposed, and the latter sectors that constitute a second group of sectors are kept attached to the former sectors by a fairing. This second group of sectors can be formed in a single piece with the fairing. The sectors can also be welded two by two along their external contact edges.

One method of manufacturing a projectile in accordance with its various embodiments comprises the following steps:

grouping of the sectors in order to form the projectile body;

positioning of at least one forward zone of the projectile body in a tool designed to heat its outer surface to a sufficient temperature to cause the material of the sectors to melt locally and weld them along their external contact edges;

cooling of the body; and assembling the projectile body and the base.

The various sectors can be made in a single casting operation in which they all are connected in a star shape at their tips.

BRIEF DESCRIPTION OF THE DRAWINGS

The invention will be better understood by reading the description hereinbelow of the various embodiments, referring to the attached drawings wherein:

FIGS. 1*a* and 1*b* represent a projectile according to a first embodiment of the invention, FIG. 1*a* being an axial lengthwise section and FIG. 1*b* being a cross section along plane AA in FIG. 1*a;*

FIGS. 7*a* and 7*b* represent a projectile according to a seventh embodiment of the invention, FIG. 7*a* being an axial lengthwise section and FIG. 7*b* being a cross section along plane JJ of FIG. 7*a* and FIG. 7*a;* and FIGS. 8A, 8B, 8C, 8D1, 8D2 and 8E show the various stages of a manufacturing process for the projectile according to FIGS. 7*a* and 7*b*.

DETAILED DESCRIPTION OF PREFERRED EMBODIMENTS

Figure 2B:
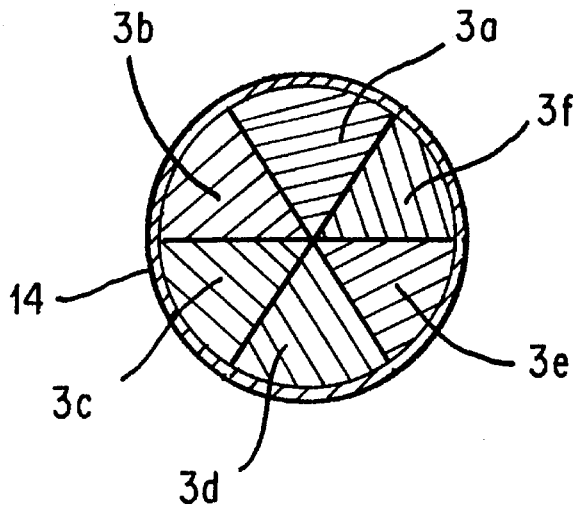
FIGS. 2*a* and 2*b* represent a projectile according to a second embodiment of the invention, FIG. 2*a* being an axial lengthwise section and FIG. 2*b* being a cross section along plane BB of FIG. 2*a;*

Referring to FIGS. 1*a* and 1*b*, a practice projectile 1 according to a first embodiment of the invention comprises a body 2 formed by assembling six identical sectors 3*a*, 3*b*, 3*c*, 3*d*, 3*e*, and 3*f*.

Each sector is delimited by two secant planes 4*a*, 4*b* that form an angle of 60°. Thus, after assembly, each sector is in contact with two neighboring sectors at its secant planes. The absence of empty space between the sectors ensures excellent rigidity of the projectile.

The projectile also has a base 5 having a receptacle 6 designed to receive sectors 3. The base 5 has a belt 7, which is an annular convexity designed to provide a seal for the propellant gases in the weapon barrel. The base also has an annular groove 8 designed to allow the projectile to be attached to a propellant charge case (not shown).

The base 5 has an internal shoulder 9 which penetrates a recess 10 provided on the body 2. This shoulder 9 attaches the base to the body.

The main function of the base is to provide a seal for propellant gases in the weapon barrel, first by means of the belt 7, and second by means of the bottom wall 11 of the base which prevents the gases from penetrating between the various sectors.

The sectors and the base are made of a plastic material of the thermoplastic type. These elements can be formed, e.g., by injection molding. The thermoplastic material provides good resistance to the various temperature and moisture stresses encountered during storage. Various thermoplastic materials can be used, including, for example: polyethylene, polyamide, polypropylene, polystyrene, polycarbonate, polyphenylene oxide, and acrylonitrile butadiene styrene.

The projectile also has a holder for ensuring that the assembly of the sectors does not separate during the transportation and handling phases. The holder provides resistance to the vibrations and other mechanical stresses that are encountered during carrying or loading of the weapon.

According to the first embodiment described here, the holder is a spot weld 12 which joins the various sectors together at the level of a forward part 13 of the projectile. This weld can be made by heating forward part 13 of the projectile locally.

The holder is designed to release the sectors as they exit the barrel of a weapon when the projectile is fired. The mechanical strength of the weld is not sufficient to withstand the forces developed upon firing.

Once the weld has broken, the sectors can move apart while still being held by the barrel of the weapon, but they move apart when they exit the barrel due to the aerodynamic drag forces exerted on the projectile. In the case of a weapon with a rifled barrel, the sectors are also subjected to a centrifugal force that tends to separate them upon exit from the barrel.

Thus it can be seen that, by appropriately sizing of the holder, it is possible to design a practice projectile intended for firing in a smooth barrel. In contrast, known projectiles of the breakup type as set forth in the background will not break apart unless they are fired from a rifled barrel.

Because of the lightness of the plastic, the velocity of the sectors decreases once they separate from the barrel. They are dispersed at a short distance from the weapon (about 50 meters for a 20 millimeter caliber).

The advantages afforded by the invention over known munitions of the breakup type are apparent: integrity in the barrel is excellent because the sectors constitute a rigid projectile body, and bursting upon exit from the weapon barrel is guaranteed because the holder is sized for this purpose. The weapon barrel is not affected by the sectors, and the energy of the sectors after dispersion is insufficient to damage the optics or to injure the handlers of the weapon.

The projectile is mounted as follows: the sectors are assembled to form body 2, which is then disposed in a tool with a matching shape; the base is set in place on the rear part of the body by elastic deformation; and the projectile is removed from the tool, and weld 12 is made by heating forward part 13.

Such a projectile is inexpensive to make. As an alternative, the holder can be constituted solely by the base itself, which will then have sufficient length to hold the sectors together.

In the other embodiments (which will now be described with reference to FIGS. 2 to 6), certain component parts of the projectile will have the same numbers as those described with reference to FIGS. 1*a* and 1*b*. These parts will not be described in further detail when they are structurally identical to those described above.

Figure 2A:
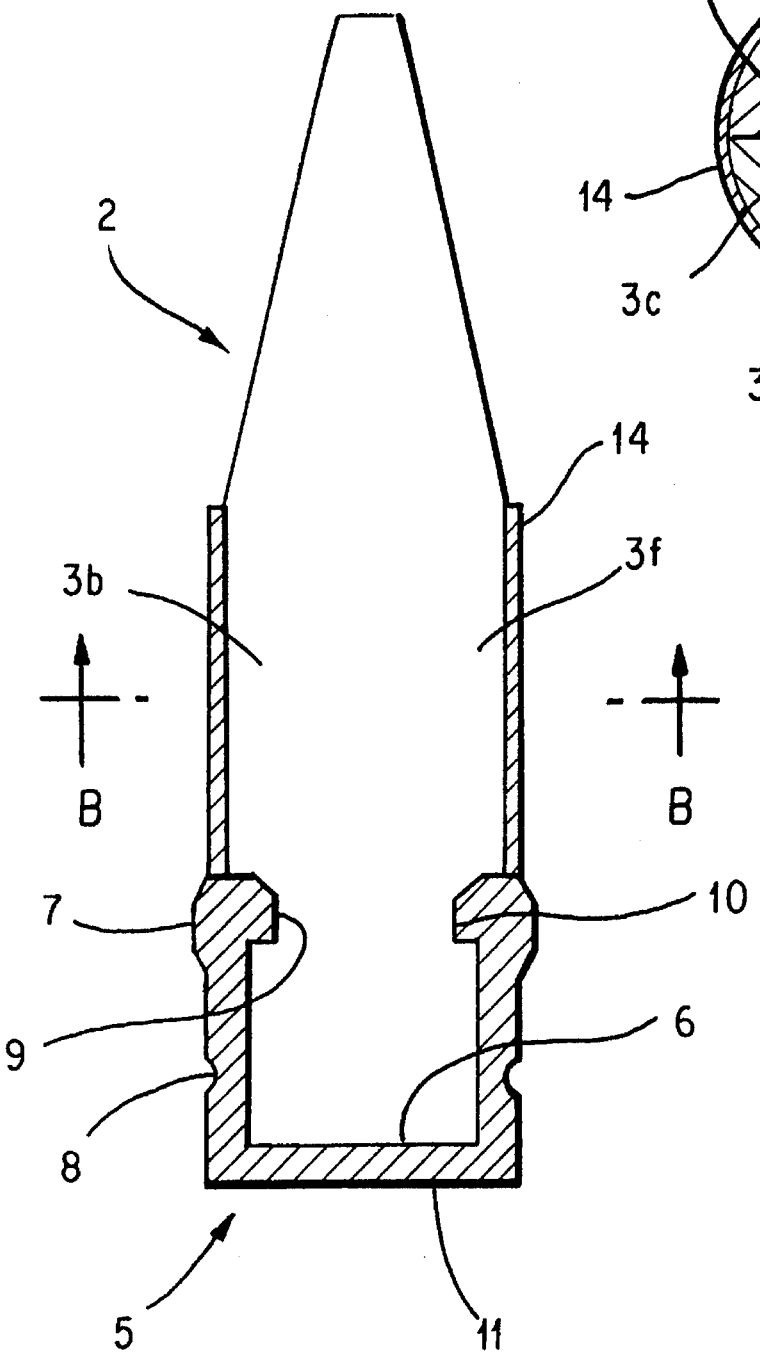

FIGS. 2*a* and 2*b* show a second embodiment in which the holder comprises a sleeve 14 made of a plastic material of the heat-shrink type. Such a material is well known to individuals skilled within the art of munitions. It is thus possible to set in place a sleeve with a diameter greater than that of the body 2 and then heat this sleeve to reduce its diameter such that it grips the body 2 tightly. With this embodiment, it is possible to modulate the strength of the holder precisely by altering the length of sleeve 14.

Figures 3A, 3B:
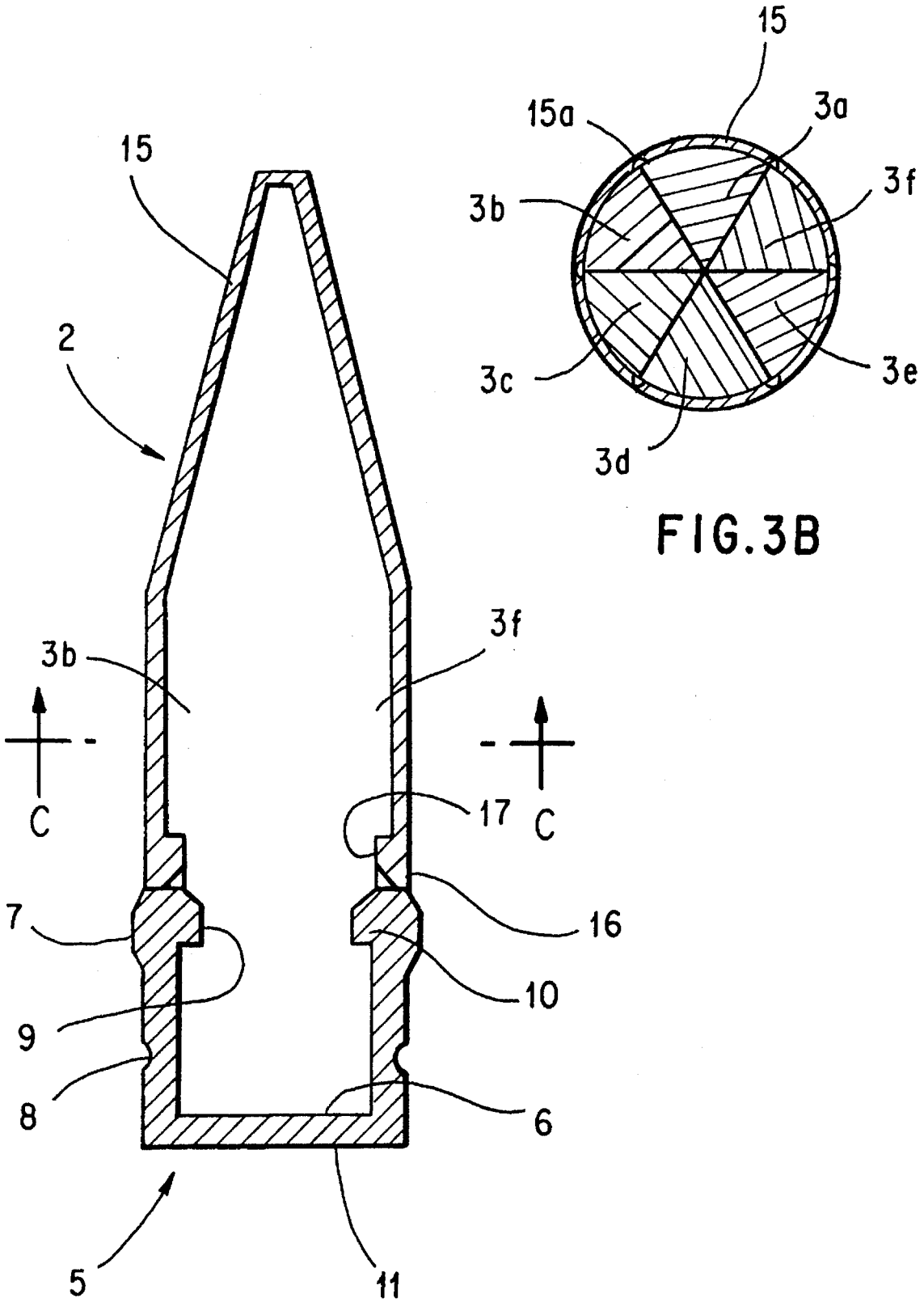
FIGS. 3*a* and 3*b* represent a projectile according to a third embodiment of the invention, FIG. 3*a* being an axial lengthwise section and FIG. 3*a* being a cross section along plane CC of FIG. 3*a;*

FIGS. 3*a* and 3*b* show a third embodiment in which the holder comprises a fairing 15 made of plastic (for example, the same type as that of which the body is made). The fairing 15 completely surrounds the forward part of the projectile. At its rear part, a strip 16 penetrates an annular recess 17 provided on the sectors 3. The strip ensures that fairing 15 is held on the sectors constituting the projectile body. The fairing is mounted by elastically deforming it, i.e., force-fitting it onto the base 10.

The thickness of the fairing will be defined as a function of the desired strength of the holder. It is possible to provide breaking points 15*a* on the fairing which are, for example, thin areas that are regularly spaced about the central axis and that run lengthwise. As a holder, the fairing provides greater resistance to environmental stresses than the spot weld. The fairing also has the advantage of preventing moisture and dust from penetrating between the sectors.

Figure 4A:
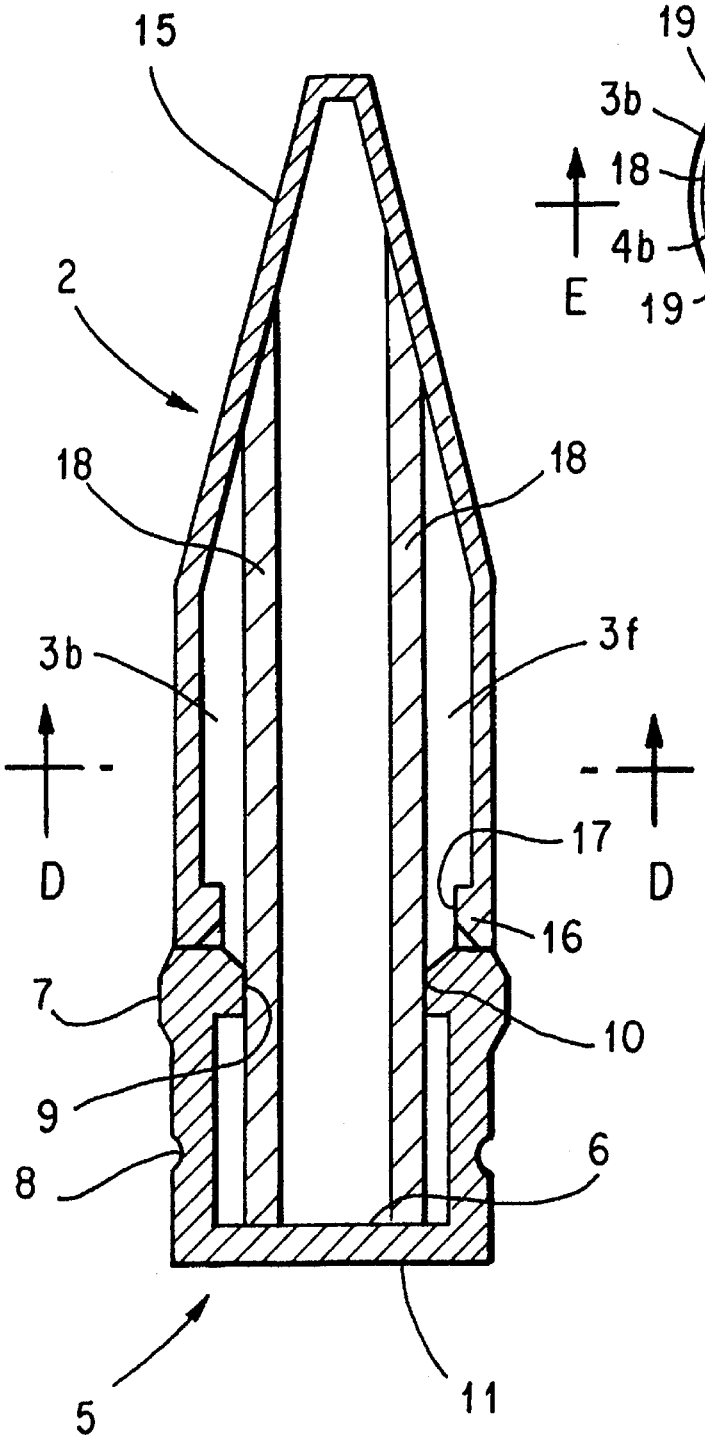
FIGS. 4*a* and 4*b* represent a projectile according to a fourth embodiment of the invention, FIG. 4*a* being an axial lengthwise section and FIG. 4*b* being a cross section along plane DD of FIG. 4*a;*
Figure 4B:
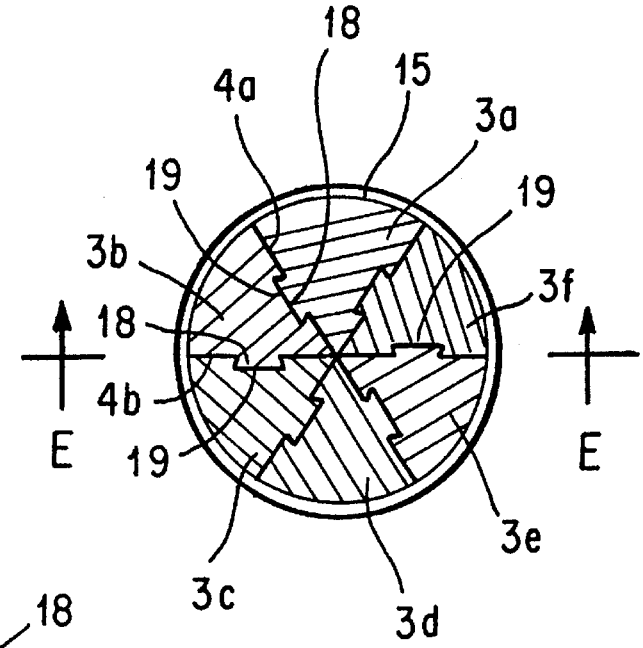

FIGS. 4*a* and 4*b* show a fourth embodiment in which the holder comprises a fairing 15 made of plastic and extensions 18 integral with the various sectors and cooperating with grooves 19 provided on the sectors. The grooves 19 have a shape that matches the extensions 18. The fairing is identical to that described with reference to FIGS. 3*a* and 3*b* and will not be described in further detail. Each sector 3 has a groove 19 on one of its secant planes 4*a* and an extension 18 on the other secant plane 4*b*. Both the grooves and the extensions extend essentially over the entire length of each sector, as can be seen in FIG. 4*a*. Both the dimensions of extensions 18 and the thickness of fairing 15 may be dimensioned to vary the strength of the linking means. The grooves and the extensions also improve the resistance of the sector assembly to environmental stresses. Alternatively, the sectors may be held by means of extensions 18 and grooves 19 alone without the fairing 15.

Figure 5A:
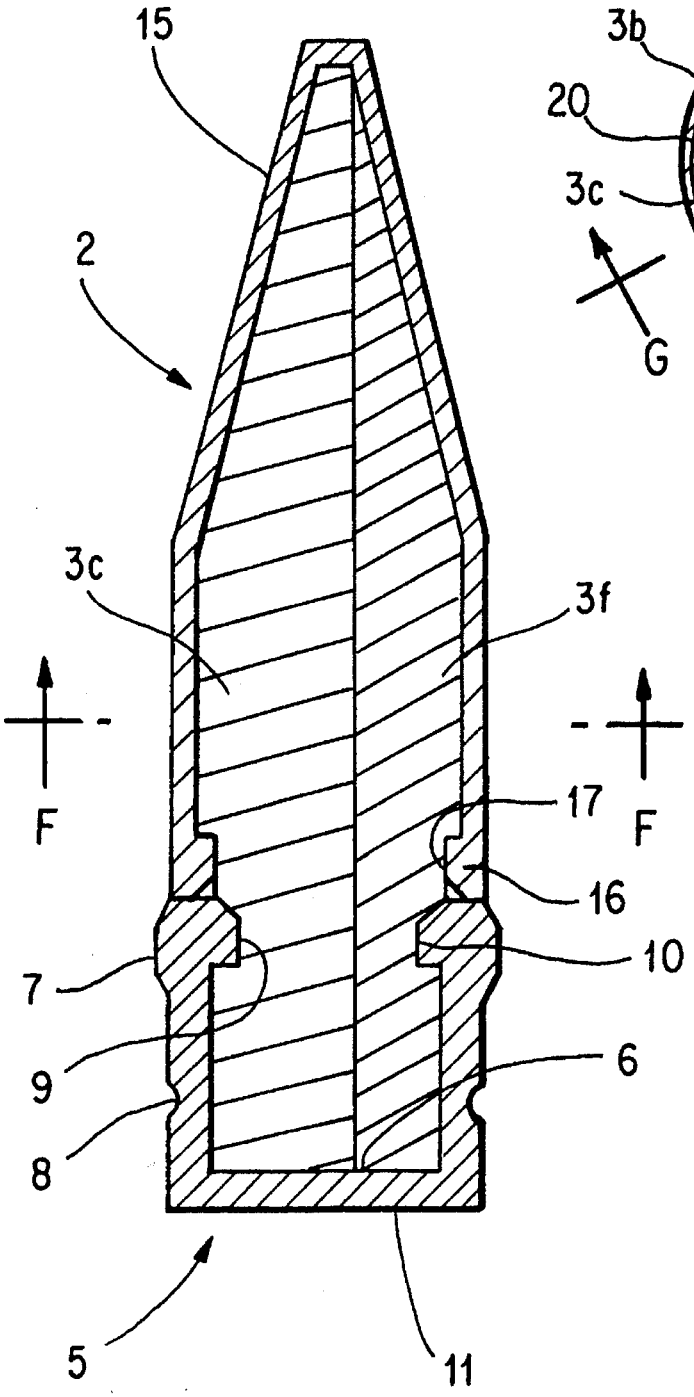
FIGS. 5*a* and 5*b* represent a projectile according to a fifth embodiment of the invention, FIG. 5*a* being an axial lengthwise section and FIG. 5*b* being a cross section along plane FF of FIG. 5*a* and FIG. 5*a;*
Figure 5B:
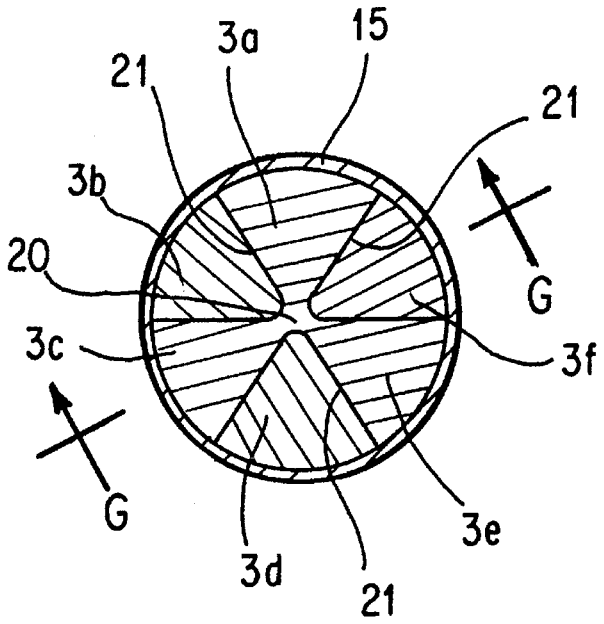

FIGS. 5*a* and 5*b* show a fifth embodiment wherein the holder comprises a fairing 15 (as described with reference to FIGS. 3*a* and 3*b*) and a central zone 20 which is formed in one piece of the three sectors 3*a*, 3*c*, and 3*e* joined together and which extends over essentially the entire length of these sectors.

These three sectors are regularly distributed about the central axis angularly, forming a first group of sectors. The first group of sectors delimits receptacles 21 in which sectors 3*b*, 3*d*, and 3*f* (the "second group of sectors") are disposed. The fairing allows the first and second groups of sectors to be attached to each other.

The dimensions of central zone 20 as well as the thickness of the fairing can be varied to adjust the strength of the linking means.

Figure 6A:
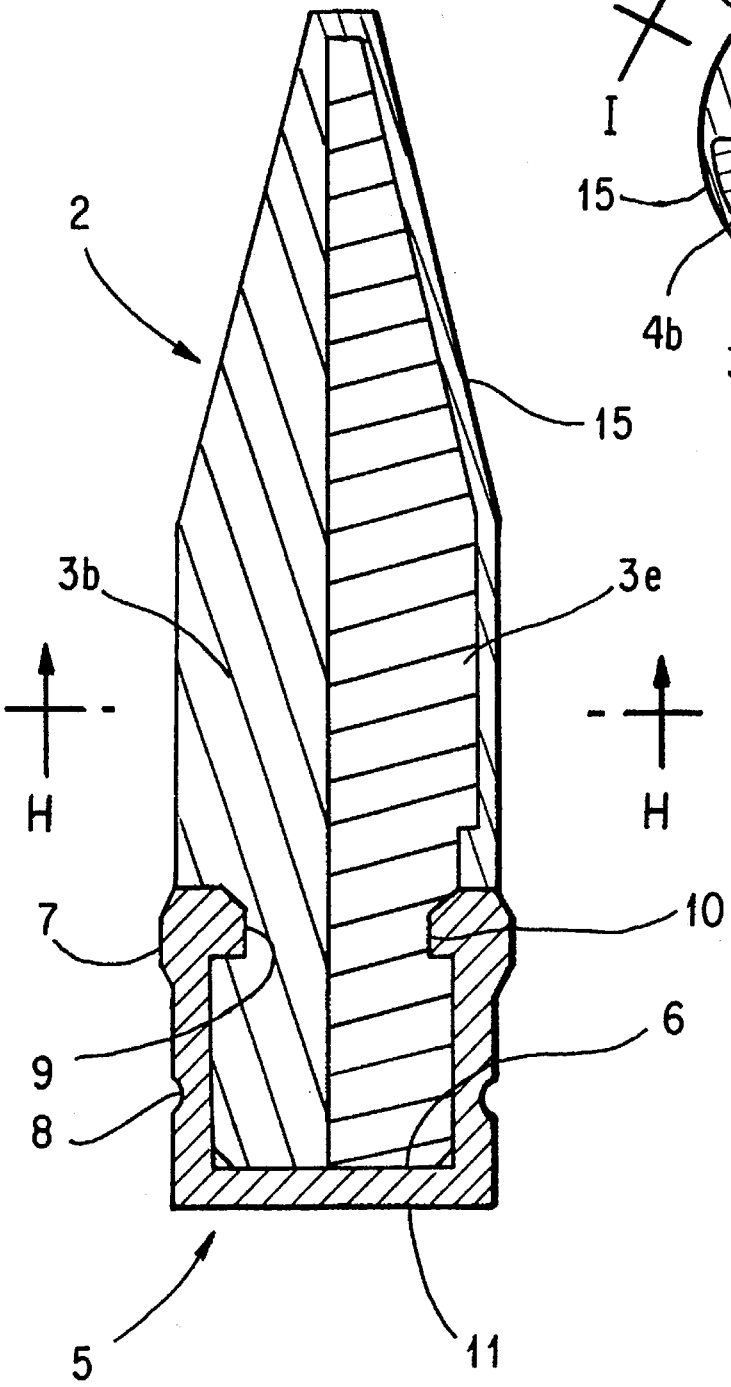
FIGS. 6*a* and 6*b* represent a projectile according to a sixth embodiment of the invention, FIG. 6*a* being an axial lengthwise section and FIG. 6*b* being a cross section along plane HH of FIG. 6*a* and FIG. 6*a;*
Figure 6B:
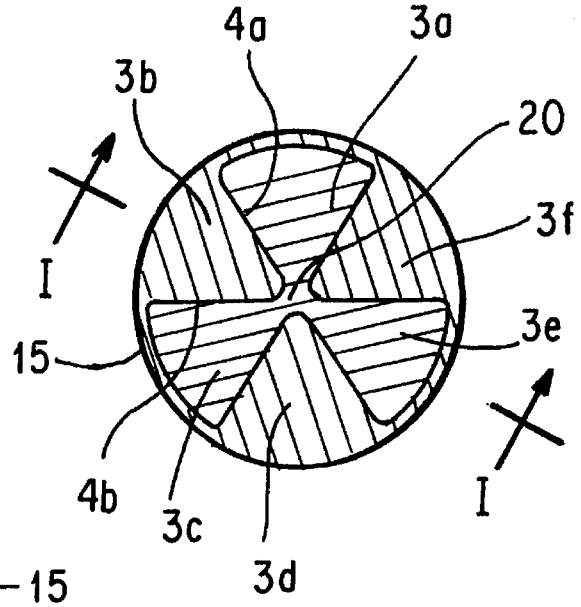

FIGS. 6*a* and 6*b* show a sixth embodiment similar to the previous embodiment, but wherein the second group of sectors (composed of sectors 3*b*, 3*d*, and 3*f*) is formed in a single piece with fairing 15. The first group of sectors, constituted by sectors 3*a*, 3*c*, and 3*e* connected by central zone 20, is thus accommodated inside fairing 15 which carries the second group of sectors. This particular embodiment allows easy assembly of the projectile since only the following two operations are necessary: installation of the first group of sectors in the fairing, and attaching the base.

The strength of the linking means can be varied by adjusting the dimensions of central zone 20 and the thickness of fairing 15 opposite the first group of sectors. In particular, it is possible to provide, on fairing 15, lengthwise breaking points disposed in the extension of secant planes 4*a* and 4*b* of the second group of sectors.

Other variants are possible without departing from the framework of the invention. Thus it is possible to combine the various holders described above with each other. For example, the weld 12 and heat-shrink sleeve can be combined, and the extensions 18 and grooves 19 can be combined with the weld or heat-shrink sleeve. In the embodiment of FIGS. 5*a* and 5*b*, the fairing can be replaced by a weld or a heat-shrink sleeve.

Figure 7A:
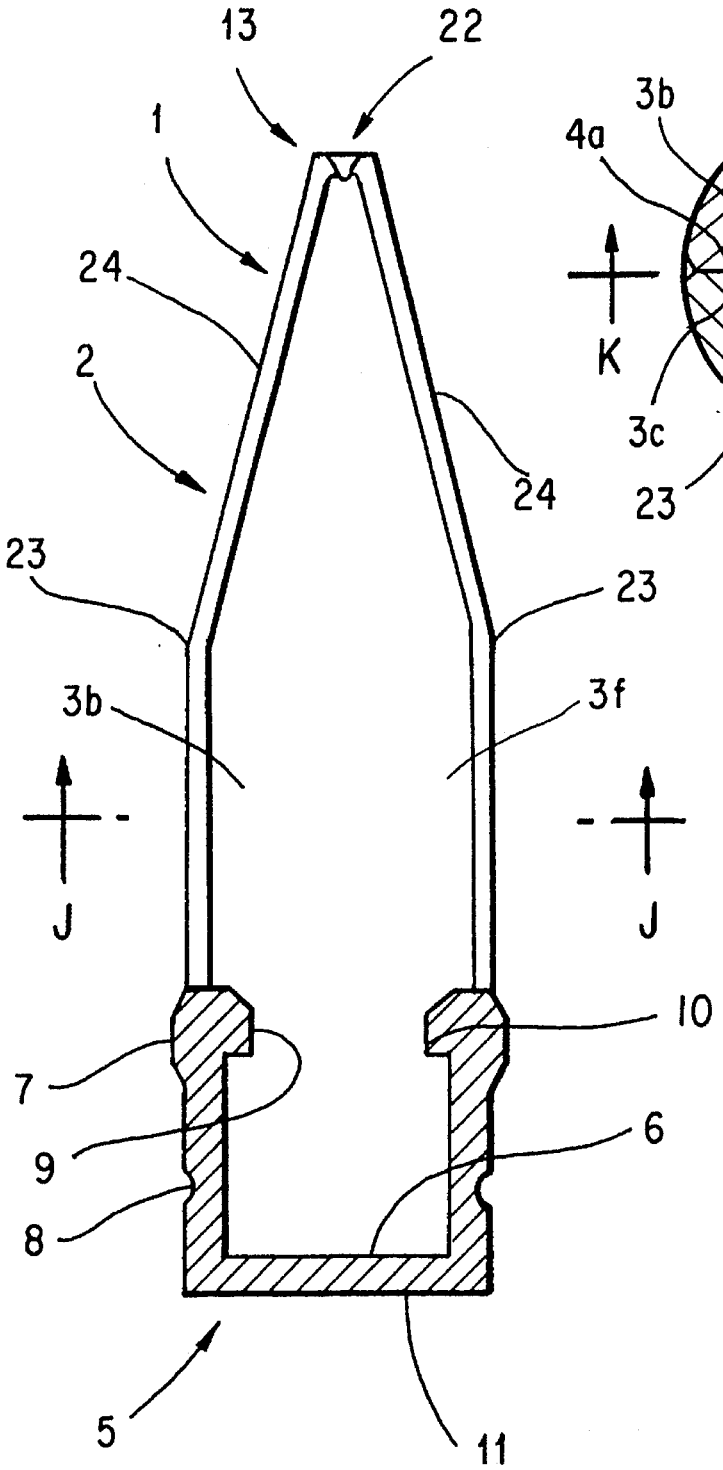
Figure 7B:
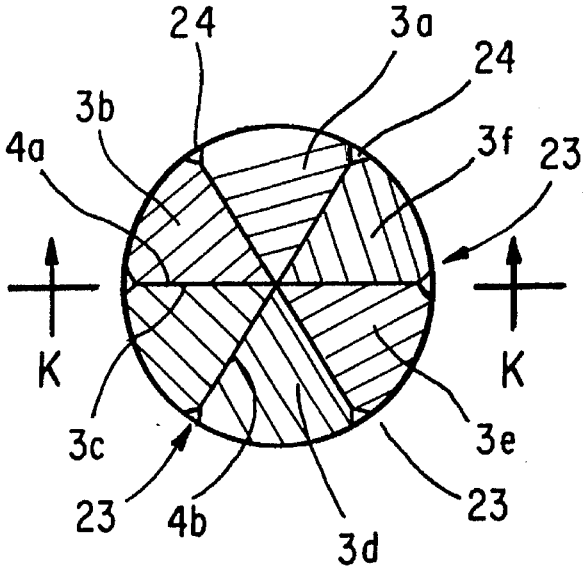

FIGS. 7*a* and 7*b* show a seventh embodiment of a projectile according to the invention. This embodiment is a variant of the embodiment described with reference to FIGS. 1*a* and 1*b*. The body 2 of the projectile 1 is again formed by assembling six identical sectors 3*a*, 3*b*, 3*c*, 3*d*, 3*e*, and 3*f*. The sectors are all joined at their tips by a plastic link 22 obtained by casting with the sectors. The sectors are also welded two by two along external contact edges 23 of secant planes 4*a*, 4*b*. These lengthwise welds 24 extend along body 2 of the projectile from its forward part 13 up to annular convexity 7 of base 5. They are obtained by heating body 2 along external contact edges 23 of secant planes 4*a*, 4*b*. Welds 24 also extend radially over a certain thickness toward the inside of the projectile. They constitute the holder for assembling the sectors, and their thickness is chosen by the individual skilled in the art as a function of the mechanical strength desired for the holder. As in the previous embodiments, a base 5 receives sectors 3 in a receptacle 6.

This embodiment has the advantage of ensuring good mechanical integrity of the assembly of sectors during the carrying or loading phases of the weapon.

With its small number of parts, this embodiment of the projectile of the present invention has a low manufacturing cost, and prevents moisture and dust from penetrating between the sectors. The lengthwise welds thus play the same role as fairing 15 described in the above embodiments.

Figure 8A:
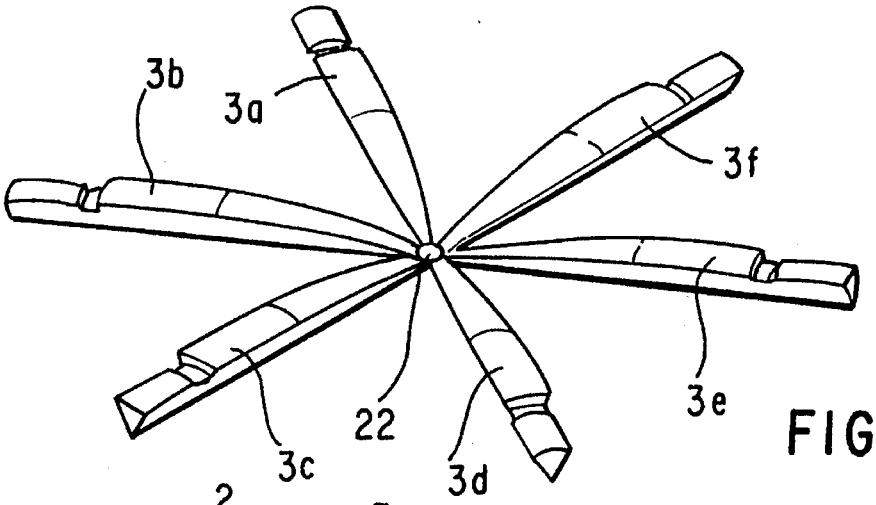

FIG. 8 shows schematically the various stages of a projectile manufacturing process according to the latter embodiment:

A. In a single casting operation in an appropriate mold (not shown), all the sectors for forming the projectile body are formed. The sectors 3*a*, 3*b*, 3*c*, 3*d*, 3*e*, and 3*f* are thus also joined into a star by link 22 at their tips (FIG. 8A).

Figure 8B:
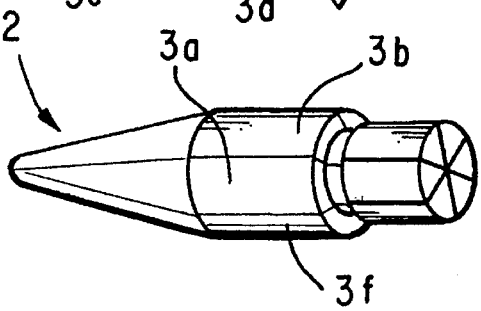

B. The sectors are regrouped to form projectile body 2 (FIG. 8B).

Figure 8C:
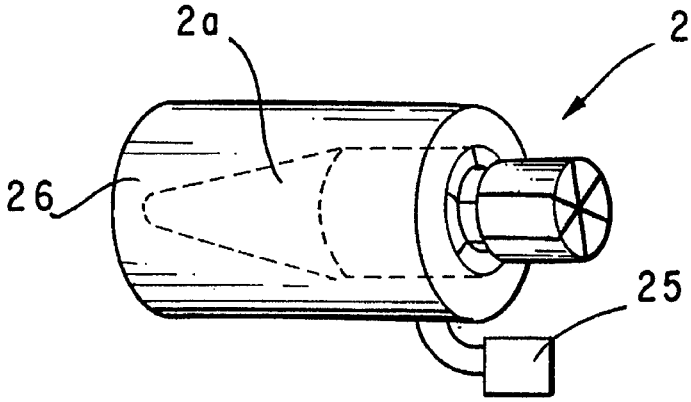

C. A forward zone 2*a* of body 2 is placed inside a tool 26 designed to heat its outer surface (FIG. 8C).

For this purpose, the tool 26 has a receptacle with a shape matching that of the forward zone 2*a* of the projectile body, so that heat is spread evenly over the entire outer surface of the forward zone 2*a*. The tool 26 is defined to raise the forward zone 2*a* to a sufficient temperature to heat the material of the sectors locally, so that they can be welded along their outer contact edges 23. Various technologies can be used for heating the tool 26. For example, an electric furnace connected to an energy source 25 could be used. A furnace in which a heating fluid circulates can also be used, or jackets 26 covering the projectile body can be immersed in a controlled-temperature bath. The individual skilled in the art will choose the welding temperature and time for which the projectile body is held at this temperature as a function of the characteristics of the thermoplastic material used and of the desired thickness of welds 24 (hence the mechanical strength of the linking means). It will be noted that, for a given heating temperature, the thickness of the weld increases with the time for which the projectile body is held at the temperature in question.

D1. Once body 2 has cooled, it is removed from tool 26 (stage D1); (FIG. 8D1). (In stage D1, the separations between sectors on the projectile body are no longer shown and the welds 24 give the forward part 2*a* of the body a smooth outer surface.)

D2 (FIG. 8D2). A base 5 is made by casting.

Figure 8E:
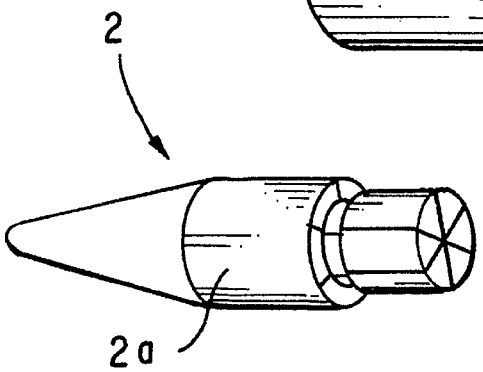
Figure 8E:
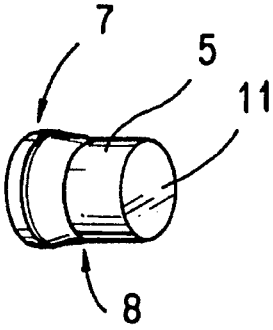
Figure 8E:
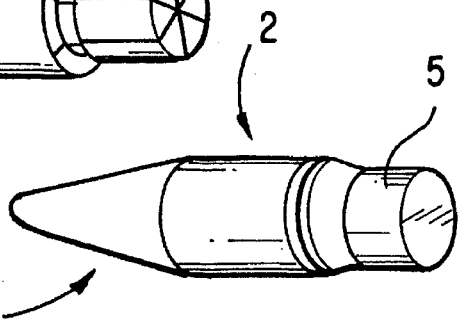

E. The body 2 of the projectile and base 5 are assembled (stage E; FIG. 8E).

This manufacturing process is particularly economical and suitable for large-scale production of projectiles according to the invention.

We claim:

1. A practice projectile designed to be fired from a barrel of a weapon, comprising:

a body formed by assembling a plurality of sectors, said sectors being made of plastic;

a base made of plastic and having a receptacle, said receptacle extending substantially through said base and terminating at an end wall, wherein said base receives said sectors such that ends of said sectors are disposed adjacent said end wall; and a frangible holder that holds said body together during handling, wherein said frangible holder breaks and releases said sectors as said practice projectile exits the barrel of the weapon when said practice projectile is fired.

2. The projectile according to claim 1, wherein the sectors are made of a thermoplastic material.

3. The projectile according to claim 2, wherein the holder comprises a fairing surrounding a forward part of said projectile.

4. The projectile according to claim 3, wherein said fairing has a strip which penetrates an annular recess provided on said sectors for attaching the fairing to said sectors.

5. The projectile according to claim 2, wherein the holder comprises a sleeve surrounding a forward part of said projectile, said sleeve being made of a heat-shrink material.

6. The projectile according to claim 3, wherein said fairing further comprises breaking points, each of said breaking points being thinner than its surrounding area, said breaking points being disposed symmetrically about a longitudinal axis of said fairing.

7. The projectile according to claim 6, wherein said breaking points extend along a length of said fairing.

8. The projectile according to claim 1, wherein the holder comprises at least one extension attached to at least one of said plurality of sectors, said at least one extension engaging a groove provided on an adjacent one of said plurality of sectors, said groove being shaped to match the shape of the extension.

9. The projectile according to claim 1, wherein the holder comprises a central element formed in a single piece with at least two sectors regularly distributed angularly and forming a first group of sectors.

10. The projectile according to claim 9, wherein the first group of sectors defines receptacles in which a second group of sectors is disposed, said second group of sectors being attached to said first group by a fairing.

11. The projectile according to claim 10, wherein the second group of sectors is formed in a single piece with said fairing.

12. The projectile according to claim 2, wherein the holder comprises at least one spot weld between at least two contiguous sectors.

13. The projectile according to claim 12, wherein said sectors are welded two by two along their external contact edges.

14. A practice projectile designed to be fired from the barrel of a weapon, comprising:

a body formed by assembling a plurality of sectors, said body being substantially symmetrical with respect to a longitudinal axis passing through a center of said body, said sectors being made of plastic;

a base made of plastic and having a receptacle, said receptacle extending substantially through said base and terminating at an end wall, wherein said base receives said sectors such that ends of said sectors are adjacent said end wall, said base having a center that is coincident with said longitudinal axis; and a frangible holder that holds said body together during handling, wherein said frangible holder breaks and releases said sectors as said practice projectile exits the barrel of the weapon when said practice projectile is fired.

* * * * *